United States Patent [19]

Crane

[11] 4,147,289

[45] Apr. 3, 1979

[54] PRODUCE LUG BOX WITH CORED-OUT PLASTIC END WALLS OVERLAPPED BY SIDE AND BOTTOM BODY WRAPPER

[75] Inventor: Walton B. Crane, Sherman Oaks, Calif.

[73] Assignee: Industrial Designs & Services, Encino, Calif.

[21] Appl. No.: 836,612

[22] Filed: Sep. 26, 1977

[51] Int. Cl.[2] ..... B65D 5/02; B65D 85/34; B65D 21/02

[52] U.S. Cl. ..... 229/23 R; 206/509

[58] Field of Search ..... 229/23 R, 23 C; 206/509, 512, 523; 220/7

[56] References Cited

U.S. PATENT DOCUMENTS

| | | | |
|---|---|---|---|
| 2,071,962 | 2/1937 | Babcock | 229/23 C X |
| 2,374,539 | 4/1945 | Guyer | 229/23 C X |
| 2,881,969 | 4/1959 | Upton | 229/23 C |
| 3,167,234 | 1/1965 | Munroe | 229/23 C |
| 3,409,202 | 11/1968 | Belcher | 229/23 R |
| 3,845,861 | 11/1974 | Fieri | 206/523 |
| 3,878,980 | 4/1975 | Crane | 206/512 |
| 3,905,541 | 9/1975 | Paxton | 206/509 |
| 3,915,372 | 10/1975 | Crane | 229/23 R |

*Primary Examiner*—Davis T. Moorhead

[57] ABSTRACT

A lug box composed of two end walls of generally rectangular conformation, composed of plastic material, and a wrapper extending between and overlapping vertical side edges and bottom of the end walls. The end walls are cored-out for lightness, but also to provide multiple ribbed structures through which nails are driven from the outside to enhance the degree of securement of the wrapper to the end walls.

3 Claims, 20 Drawing Figures

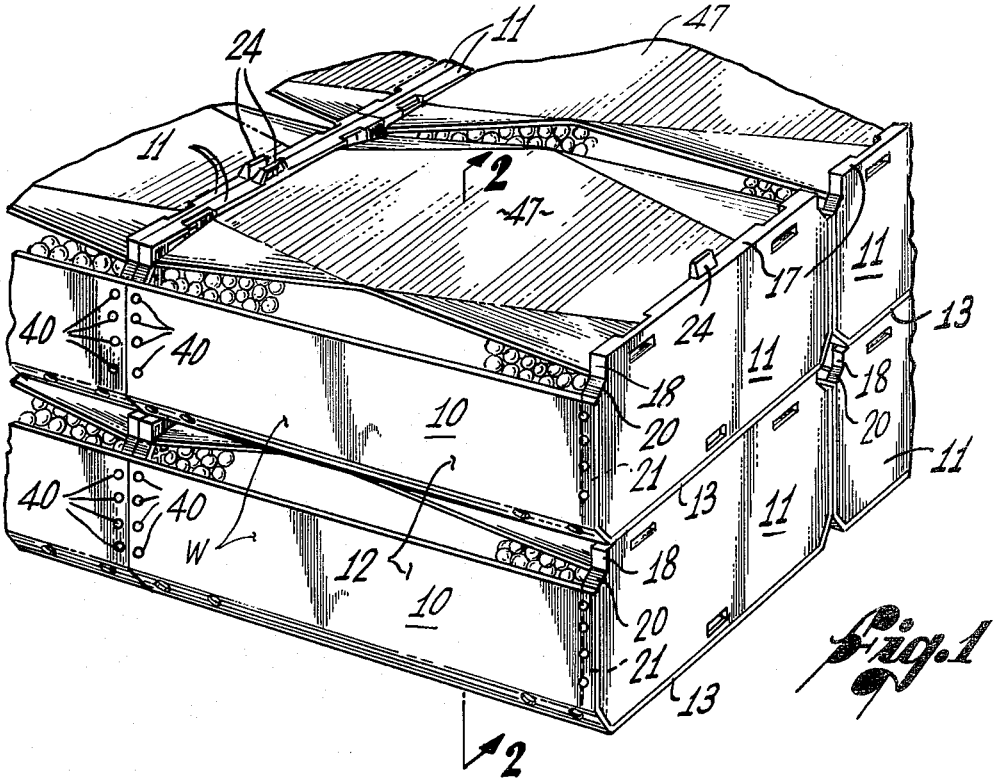
Fig. 1
Fig. 2
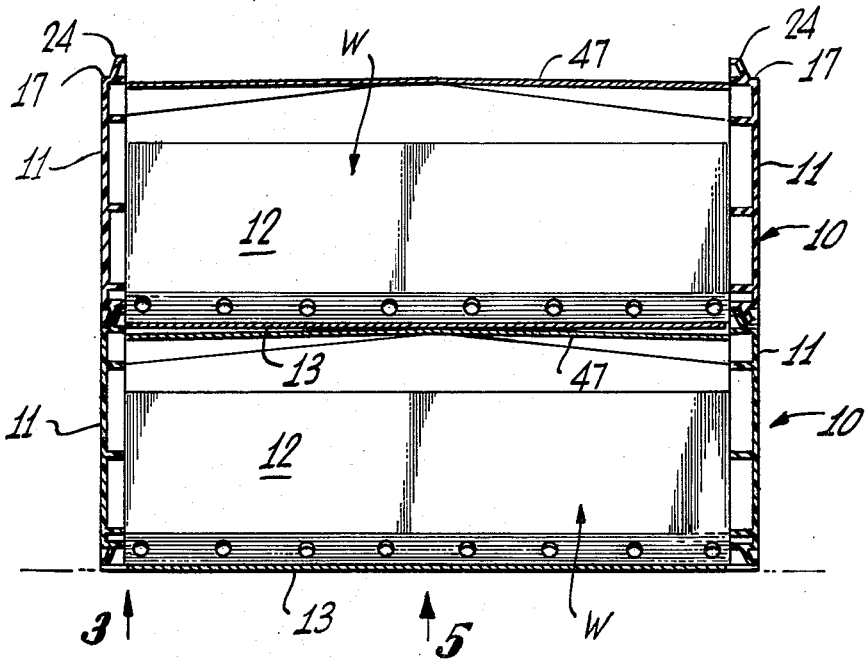
Fig. 3
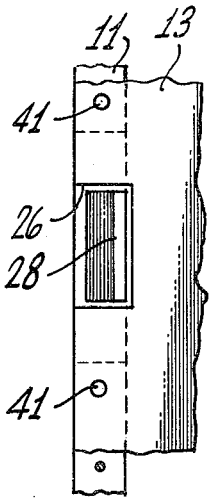

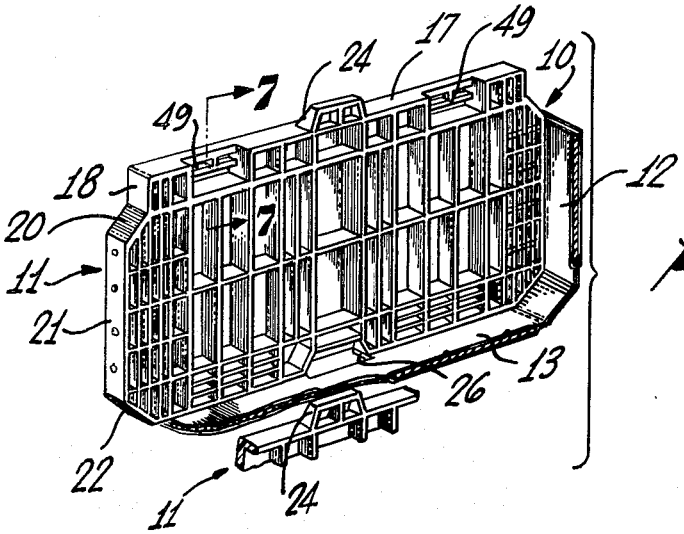
Fig.4
Fig.5
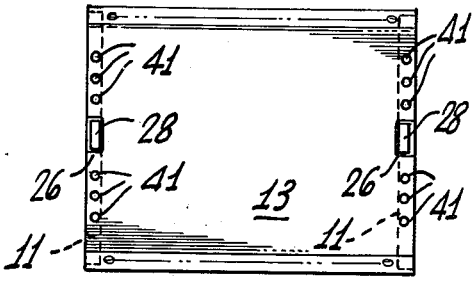
Fig.6
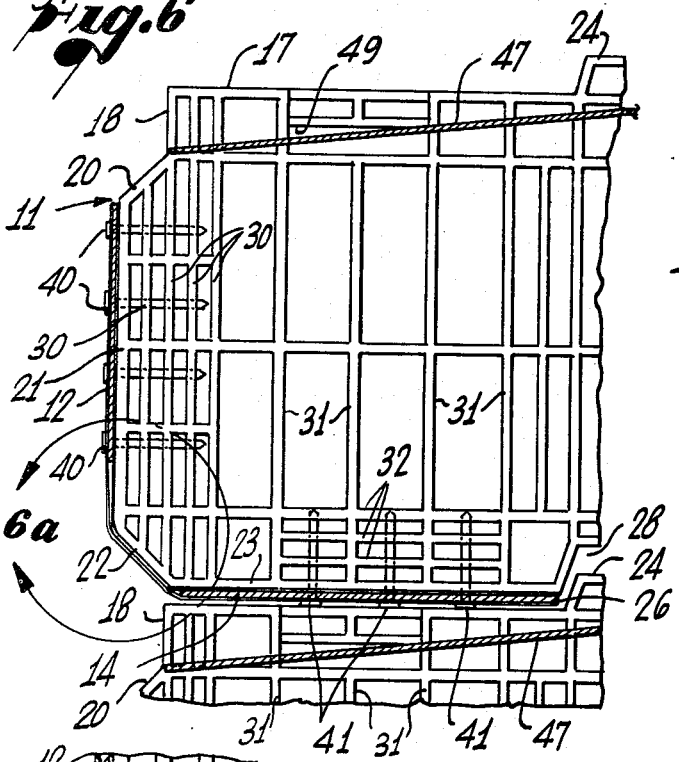
Fig.7
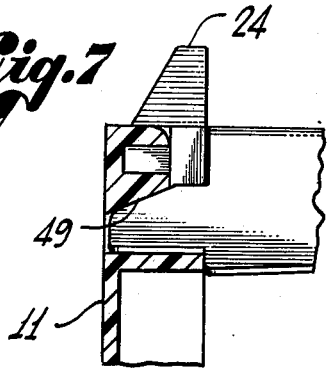
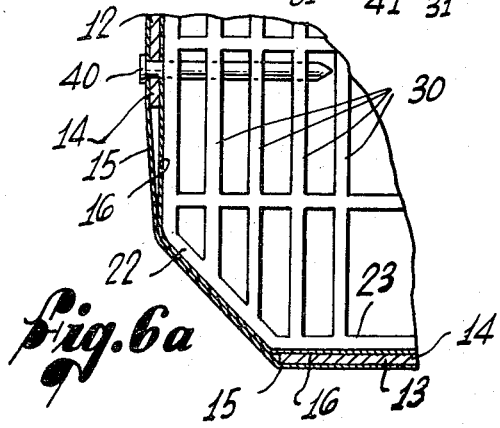
Fig.6a
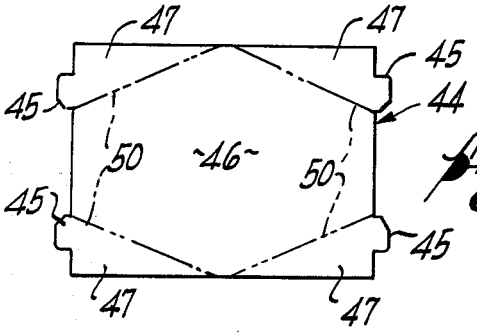
Fig.8

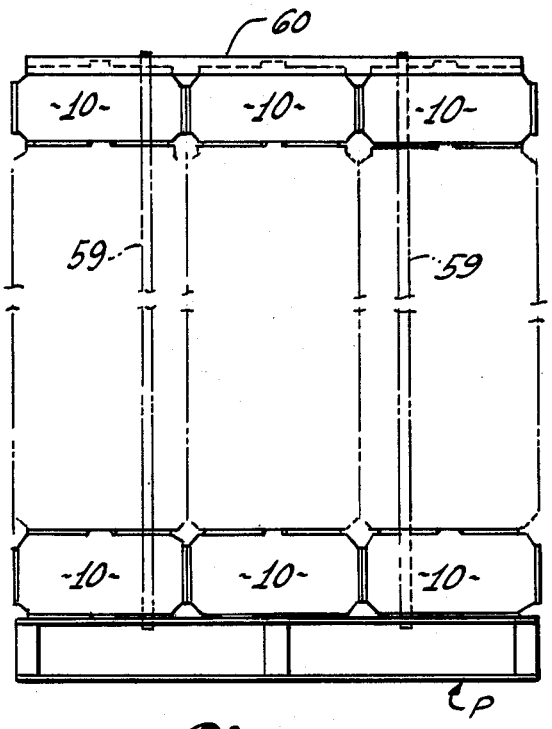
Fig. 9
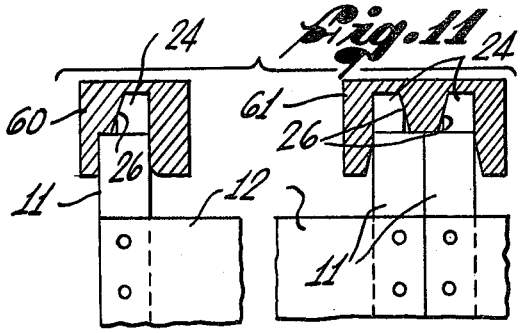
Fig. 11
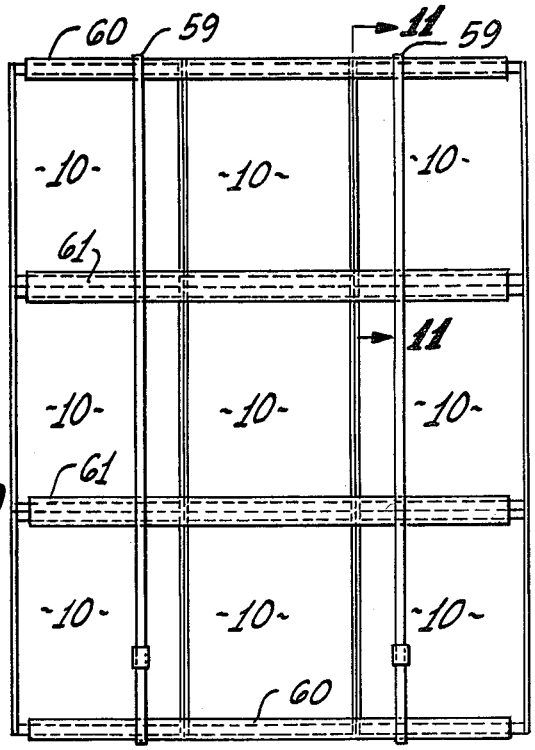
Fig. 10
Fig. 12
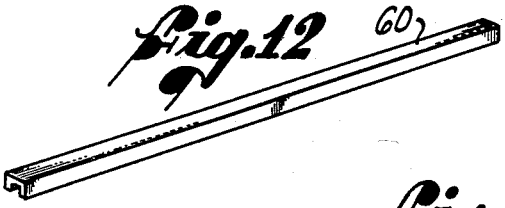
Fig. 13
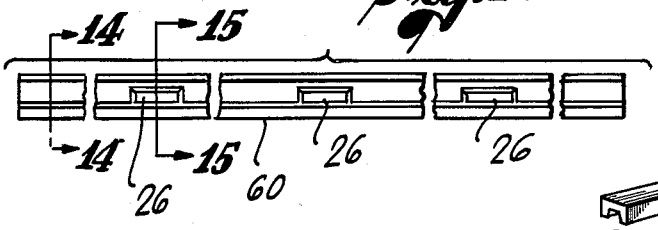
Fig. 16
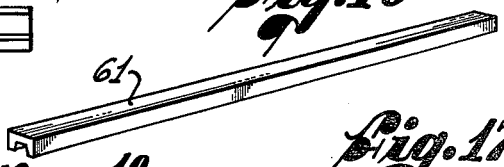
Fig. 17
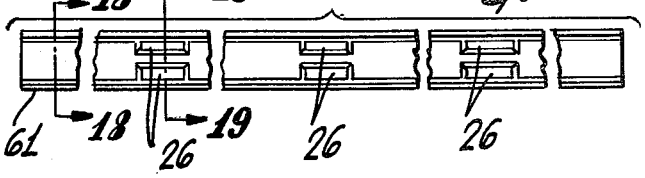
Fig. 14
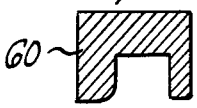
Fig. 15
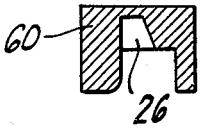
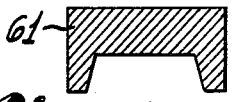
Fig. 18
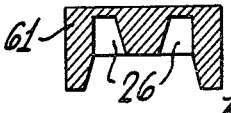
Fig. 19

PRODUCE LUG BOX WITH CORED-OUT PLASTIC END WALLS OVERLAPPED BY SIDE AND BOTTOM BODY WRAPPER

FIELD OF THE INVENTION

This invention relates generally to a generally known type of lug box or "tray" esepcially composed primarily of plastic, adapted to hold certain types of produce typified by grapes, and adapted for vertical stacking for transportation from the field, or in subsequent commercial shipment.

BACKGROUND OF THE INVENTION

There are a number of very generally similar lug boxes or trays known in the prior art, which I have developed at an earlier date, and over which the present invention is a material and inventive improvement, and/or simplification when taking its intended usage into account, such as my U.S. Pat. No. 3,878,970. Added examples will serve no purpose, since the present lug box differs from this type and use about the same general way.

BRIEF DESCRIPTION OF THE INVENTION

The present invention provides, in a present preferred embodiment, stackable lug boxes or trays, having at opposite ends coredout molded plastic end walls, each formed along the top with a horizontal stacking edge or edge flange. At each end, this stacking edge joins on each side a short depending end wall, which in turn meets an outwardly jutting angular shoulder. The latter joins a vertical downwardly extending end edge wall, and the latter eventually turn angularly inward to a horizontal bottom edge wall or flange.

The sides and bottom of the tray are a body comprised of a wrapper wrapping about the aforesaid depending end walls, the angularly turned lower portion of the latter, and its aforesaid horizontal bottom edge or edge wall.

This wrapper may be made of a thin, preferably wooden or plastic filler, to opposite sides of which are joined a layer of kraft paper or other suitable strong sheeting. Preferably, the filler is not necessarily continuous, but may or will have a gap above the angularly inwardly turned area.

The cored-out end walls of the tray are slotted adjacent their extremities into a vertically ribbed structure for lightness, and to provide a further highly useful and novel feature of utility. That is to say, in order to gain a high degree of securement of the side walls to the aforementioned downwardly extending end walls, a plurality of nails are driven in through the side walls, thence through the underlying end wall and finally into the vertically ribbed structure, i.e., fairly close spaced vertical ribs of the end wall. Similar fairly close-spaced horizontal ribs and vertical nails therethrough are used along the bottoms of the end walls.

Further significant features of the invention can best be left for description in connection with the drawings, which will now be described.

IN THE DRAWING SHOWING A PRESENT EMBODIMENT

FIG. 1 is a perspective fragmentary view of a nest of eight of the stacked trays, understood to be supported by a conventional pallet, and showing four pairs of trays stacked two deep;

FIG. 2 is a vertical section on line 2—2 of FIG. 1;

FIG. 3 is a fragmentary view looking upwardly along the direction of arrow 3 of FIG. 2;

FIG. 4 shows a tray end or end wall in perspective, with a fragmentary portion of the next below tray end in an unjoined position;

FIG 5 is a bottom plan view of the tray;

FIG. 6 is a broken away front elevational view of two of the container end walls joined vertically in a stack;

FIG. 6*a* is an enlargement of a fragmentary portion of FIG. 6;

FIG. 7 is a detail view taken on line 7—7 of FIG. 4, showing an end wall juncture;

FIG. 8 is a plan view of a tray cover in accordance with the invention;

FIG. 9 is a somewhat diagrammatic elevation of a partially broken away stack of trays or lug boxes as normally supported in a single conventional pallet, it being understood that a single pallet will normally support a horizontal arrangement of 3 × 3 trays or lug boxes, to a height of 9 to 11 such units;

FIG. 10 is a somewhat diagrammatic plan view of a stack of "lug boxes" such as are supported at the bottom on a single pallet, in a 3 × 3 arrangement, and showing also certain single and double one piece locking bars at the very top;

FIG. 11 is a fragmentary section on line 11—11 of FIG. 10;

FIG. 12 is a perspective view of a "single" locking bar;

FIG. 13 is a bottom plan view of a "single" locking bar;

FIGS. 14 and 15 are cross-sections of single locking bars on lines 14—14 and 15—15, respectively, of FIG. 13;

FIG. 16 is a perspective of a "double" locking bar;

FIG. 17 is a bottom plan view of the "double" locking bar; and

FIGS. 18 and 19 are cross-sections of double locking bars on lines 18—18 and 19—19, respectively.

DESCRIPTION OF THE ILLUSTRATIVE EMBODIMENT

In the drawings, and referring first to FIG. 1, the trays are individually designated generally by the numeral 10, each with two cores or cored-out molded thermosetting plastic opposite end walls 11, and each such wall or core has wrapped about the vertical side and bottom edges thereof a wrapper *w* to provide the tray with opposite vertical side walls 12 and a bottom 13. The coringout may vary to a substantial extent, but in general will run to something substantially in the range of 75% to about 80%. The drawings show a representative example. In the illustrative embodiment, the side and bottom walls 12 and 13 of the wrapper are composed preferably of layers 14 of wood filler, which may or may not be veneered, to opposite faces of which are adhesively joined layers 15 and 16, respectively, of kraft paper (FIG. 6*a*). The wood filler may comprise single layers of wood, or alternatively several adhesively joined thin wood plies. As a further alternative, of many available within the invention, I may advantageously use, as an equivalent, a suitable plastic material laminated between layers of liner board or paper.

Considering the opposite end walls 11 of the tray in more particular, each has formed at the top a horizontal stacking edge or flange 17. At each end, this stacking edge at the top meets a short downwardly extending vertical end edge 18, which in turn meets an outwardly angled shoulder 20. The latter then meets a vertical further downwardly extending end wall or edge 21, and the latter eventually turns angularly inward, as at 22, to horizontal bottom edge 23 (FIGS. 6 and 6*a*).

At the center of top stacking edge 17 of each end wall is an interlocking prong 24, adapted for close reception into a vertical notch 26 in the registering wrapper bottom and upwardly tapering notch bottom portion 28 in the bottom of the end wall immediately above.

It will be appreciated that the ribbed or cored out end walls 11 are susceptible to embodiment in various patterns. As here illustratively shown, each end wall 11 has formed just inside thereof a plurality of three or four close-spaced vertical ribs 30. Inside thereof the coring takes a wider spaced pattern, thus having a number of vertical ribs such as 31, FIG. 6, of considerably wider spacing, for example, approximately as illustrated in FIGS. 4 and 6. Horizontally across the bottoms of the end walls 11, on each half thereof, are three close-spaced horizontal ribs 32, generally like the aforementioned vertical ribs 30.

The aforementioned wrapper w has vertical sides 12, which overlap end walls 11, and are stretched therebetween, from the top of the vertical side edge 21 of the tray over the inwardly angled portion 22, and bottom 13 in contact with the horizontal bottom edges 23 of the two end walls 11.

Nails 40 are driven horizontally in through the sides of the wrapper overlying the vertical side edges of the end side edge or walls 21, and in through the end walls 11 and successively through the vertical ribs 30; and nails 41 are driven vertically upward through the wrapper bottom, the lower edges 23 of the end walls, and in through the successive horizontal ribs 32. The nails thus become secured extra tightly to the "close-spaced" vertical and bottom horizontal ribs.

A paperboard cover 44, preferably corrugated board, of generally rectangular shape (FIG. 8) has at each end two spaced end tabs 45 receivable in pockets 49 in the tops of the end walls, and is bendable along pairs of generally divergent diagonal lines 50 which might form a diamond shaped Figure on the cover, but is preferably more divergent, as suggested in the drawings. These are represented as score lines. The part 46 of the rectangular piece inside the diagonal score lines thus stands substantially flat, while outside these score or bend lines, the remaining triangular "outside" portions 47 of the rectangular piece are bendable downward. The four tabs 45 positioned as shown relative to the diagonal "score lines" engage in the pockets 49 (FIG. 7), bending these remaining portions 47 substantially downward. The angle of these score lines, as can be seen in FIG. 8, being advantageously in the range of 20° - 25°, depending perhaps among other things upon the spread of the tabs 45 The inside corners of the tabs 45 are angularly relieved, as shown, to facilitate installation of the cover. In practice, the two tabs at one end of the cover are first inserted in mating end wall pockets 49 of one end wall. The cover, being bendable to a degree on the score lines, as well as yieldable, or subject to deformation under application of moderate force, can then be easily forced and flexed so as to cause its corner-relieved opposite end tabs into the corresponding or mating pockets 49 in the opposite end wall. When the applied insertion force is relieved, the cover may expand slightly into its final locked-in-place condition.

FIG. 9 shows a side elvation of a stack of the lug boxes on a elevation pallet P. There may be say eleven lug boxes in such a vertical stack. FIG. 9 shows the bottom level lug boxes, and a little over one and one-half of the two top level lug boxes, the remainder being broken away as indicated. Each such stack consists of a group of three lug boxes 10 by three lug boxes 10, as shown in FIG. 10. They are wrapped vertically by two steel tapes 59.

Running the short way across the tops of the top level lug boxes (FIG. 10) are one-piece outside single and inside double cap-pieces, in the nature of locking, clamping or securement bars 60 and 61, respectively, longitudinally grooved on the undersides thereof, as shown. These are notched at 26 to receive the upstanding lugs 24.

The aforementioned steel loop straps 59 loop over the bars 60 and 61 to hold the stacks in tight vertical assembly. The bars 60 provide a platform on which a second loaded pallet (up to three normally) may be stacked.

This completes a description of a present illustrative embodiment of the invention. Various changes in design, structure and arrangement may of course be made without departing from the scope of the appended claims.

What is claimed is:

1. A lug box for holding produce and the like comprising:

a pair of parallel and generally rectangular plastic end walls defining opposite ends of said box, each of said end walls being approximately 75 to 80 percent cored-out, having top, bottom and side edges, angled shoulders joining said edges and a plurality of paralle, horizontal and vertical ribs adjacent said bottom and side edges;

a wrapper extending between and overlapping said bottom and side edges of said end walls and forming a bottom and sides for said box, said wrapper being formed by a plurality of layers of wood filler and a veneer of kraft paper adhesively joined to said wood filler;

a plurality of nails driven through said wrapper and into said ribs, said nails being substantially perpendicular to said ribs and securing said wrapper to said end walls; and a generally rectangular cover forming a top for said box, said cover being relatively stiff but bendable along two pairs of convergent score lines, said score lines defining downwardly bent triangular outside portions having dependent tabs, and said end walls defining pockets in which said tabs are received.

2. A lug box for holding produce and the like comprising:

a pair of parallel and generally rectangular plastic end walls defining opposite ends of said box, each of said end walls being approximately 75 to 80 percent cored-out, having top, bottom and side edges, angled shoulders joining said edges and a plurality of parallel, horizontal and vertical ribs adjacent said bottom and side edges;

a wrapper extending between and overlapping said bottom and side edges of said end walls and forming a bottom and sides for said box, said wrapper being formed by a plurality of layers of wood filler and a veneer of kraft paper adhesively joined to said wood filler;

a plurality of nails driven through said wrapper and into said ribs, said nails being substantially perpendicular to some of said ribs and securing said wrapper to said end walls; and a generally rectangular cover forming a top for said box, said cover being relatively stiff but bendable and having dependent tabs, and said end walls defining pockets in which said tabs are received.

3. A lug box for holding produce and the like comprising:

a pair of parallel and generally rectangular plastic end walls defining opposite ends of said box, each of said end walls being approximately 75 to 80 percent cored-out, having top, bottom and side edges, angled shoulders joining said edges and a plurality of parallel, horizontal and vertical ribs adjacent said bottom and side edges;

a wrapper extending between and overlapping said bottom and side edges of said end walls and forming a bottom and sides for said box;

a plurality of nails driven through said wrapper and into said ribs, said nails being substantially perpendicular to some of said ribs and securing said wrapper to said end walls; and a generally rectangular cover forming a top for said box, said cover relatively stiff but bendable and having dependent tabs, and said end walls defining pockets in which said tabs are received.

* * * * *